United States Patent [19]

Clarke

[11] 4,324,535

[45] Apr. 13, 1982

[54] SLANT AXIS ROTARY PISTON MECHANISM WITH FIXED SINUOUS PARTITION IN GROOVED ROTOR

[75] Inventor: John M. Clarke, Dunlap, Ill.

[73] Assignee: Caterpillar Tractor Co., Peoria, Ill.

[21] Appl. No.: 149,351

[22] PCT Filed: Jan. 24, 1980

[86] PCT No.: PCT/US80/00076

§ 371 Date: Jan. 24, 1980

§ 102(e) Date: Jan. 24, 1980

[87] PCT Pub. No.: WO81/02183

PCT Pub. Date: Aug. 6, 1981

[51] Int. Cl.[3] ..... F01C 1/00; F01C 19/00

[52] U.S. Cl. ..... 418/51; 418/53

[58] Field of Search ..... 418/49–53, 418/68, 209, 210, 212; 123/241; 73/258

[56] References Cited

U.S. PATENT DOCUMENTS

| | | | |
|---|---|---|---|
| 277,648 | 5/1883 | Winkler | 418/53 |
| 1,840,711 | 1/1932 | Goodner | 418/53 |
| 2,031,125 | 2/1936 | Peschl | 418/53 |
| 2,997,000 | 8/1961 | Becker et al. | 418/53 |
| 3,323,466 | 6/1967 | Ford | 418/50 |
| 3,485,218 | 12/1969 | Clarke | 418/53 |
| 3,492,974 | 2/1970 | Kreimeyer | 418/53 |
| 3,667,876 | 6/1972 | Boyd | 418/68 |
| 3,999,902 | 12/1976 | Walker | 418/53 |
| 4,181,478 | 1/1980 | Weber | 418/51 |

*Primary Examiner*—John J. Vrablik

*Attorney, Agent, or Firm*—Wegner, Stellman, McCord, Wiles & Wood

[57] ABSTRACT

A slant axis rotary piston mechanism including a shaft (42) having an angularly offset eccentric (44) and a housing (10) defining a general spherical chamber (22) journalling the shaft and containing the eccentric. A peripheral, generally sinuous partition (20) is fixed in the housing and extends radially into the chamber towards the eccentric. A rotor (62) is journalled on the eccentric and is of generally spherical exterior configuration (64) and has a peripheral groove (66, 68, 70) extending about and opening to its periphery. Each of the sides (66 and 68) of the groove face a corresponding side (24, 26) of the partition and define therewith at least two working volumes of variable volume. Gears (108, 110) synchronize relative movement between the shaft, the rotor and the housing, and ports (90, 92, 94, 96) provide for ingress and egress of working fluid to the working volumes.

8 Claims, 4 Drawing Figures

Fig. 2. TIMING SCHEMATIC
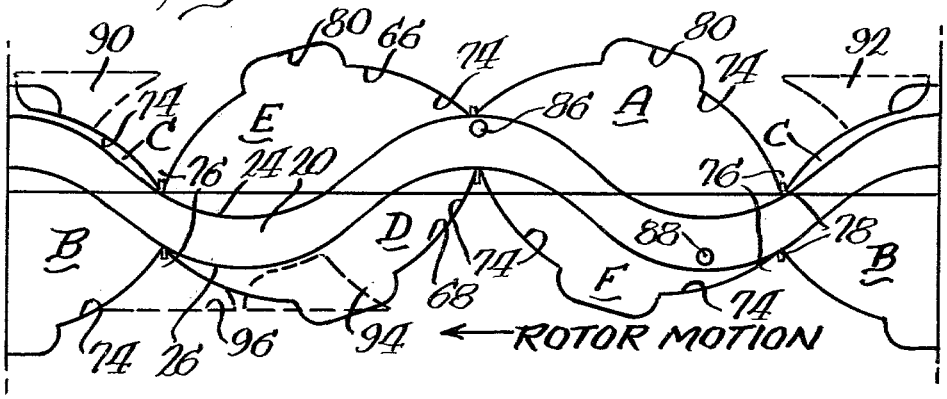
Fig. 3. TIMING SCHEMATIC +30° ROTATION
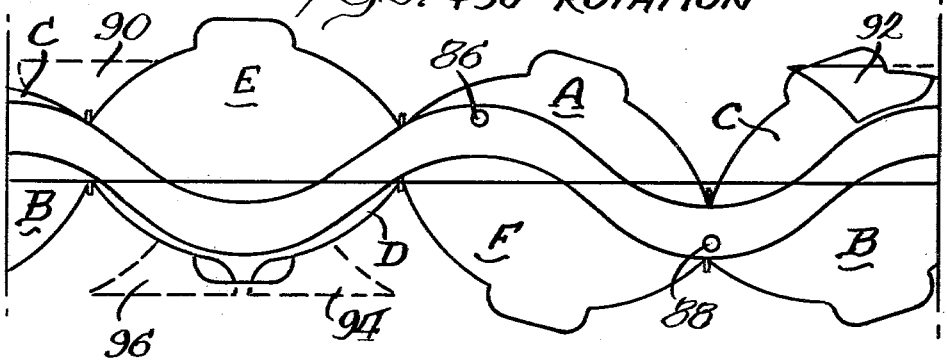
Fig. 4. TIMING SCHEMATIC +60° ROTATION
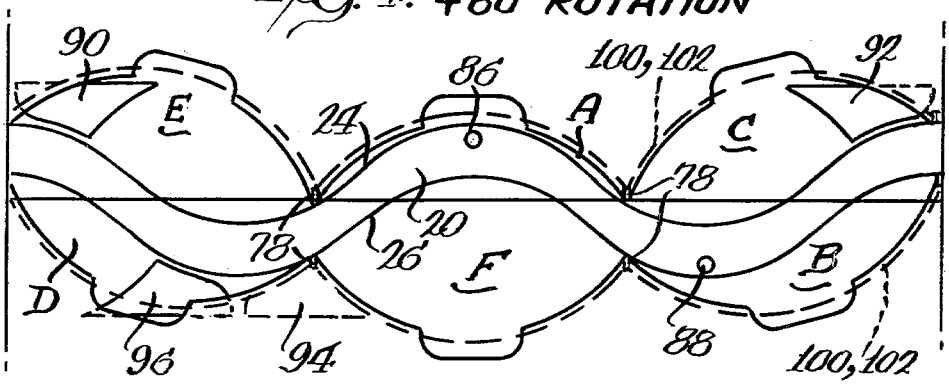

SLANT AXIS ROTARY PISTON MECHANISM WITH FIXED SINUOUS PARTITION IN GROOVED ROTOR

TECHNICAL FIELD

This invention relates to mechanisms which operate on a working fluid such as engines, compressors, expanders or the like. More particularly, the invention relates to a slant axis rotary piston type of such machanism.

BACKGROUND ART

Recent years have seen a considerable upsurge in the focus of attention upon positive displacement rotary mechanisms to be utilized as engines, compressors, expanders or the like. The interest is in a large part due to the considerable reduction in the number of moving parts required in a rotary mechanism versus a reciprocating mechanism of similar displacement. This considerable advantage has, at the same time, been offset to some degree by disadvantages associated with rotary mechanisms. For example, in rotary mechanisms utilized as engines, there frequently is a high surface to volume ratio of the working volumes which reduces efficiency of the combustion process thereby reducing the amount of work obtained from a given unit of fuel and which will frequently result in an increase in hydrocarbon emissions over that generated by a reciprocating mechanism of similar displacement.

More particularly, when extended areas of opposed moving parts defining a working volume are in extremely close proximity to each other, the volume of working fluid between such parts in such an area does not participate in the combustion process, generally because the surfaces of the mechanical parts are cool and the spacing of the parts with respect to each other is so small that temperatures sufficient to maintain combustion cannot be obtained. In other words, as soon as the flame of combustion attempts to enter the space, it is immediately quenched by the cool surfaces. Consequently, fuel in the volume between the two closely adjacent surfaces does not burn and exits the mechanism as a hydrocarbon emission.

A volume of this type forming part of a working volume of an engine is known as "parasitic volume" because it does not assist in producing energy and in fact may actually absorb energy through the heat rejection process. In many cases, it may limit the maximum attainable compression ratio to some value less than the optimum value; and in most cases, the higher the compression ratio, the more efficient the engine will operate. And in cases where, due to engine geometry, the maximum compression ratio is less than that determined to be optimum to permit the engine to operate on a particular cycle as, for example, a diesel cycle, the problem of maximizing engine efficiency is made more acute.

Trochoidal mechanisms are typical of those wherein engine geometry limits the maximum attainable compression ratio. For reasons that not need be elucidated here, as one alters the geometry of a trochoidal engine to increase its compression ratio, the engine becomes bulky for the same power. Excessive bulk occurs at some point which is less than desirable. Therefore, it has been necessary to provide such engines with multiple stages, generally two, the first for initial compression of air and final expansion of combustion gases and the second for final compression of air, combustion and initial expansion of combustion gases. This, of course, complicates the engine and increases the number of moving parts thereby making a rotary mechanism less attractive when compared to a reciprocating one.

Engine geometry difficulties as far as obtaining high compression ratios are nowhere near as prevalent in slant axis rotary piston mechanisms and while the given slant axis rotary piston mechanism has a maximum compression ratio determined by its geometry, it will be sufficiently high that optimal diesel cycle compression ratios can be obtained without multiple staging. Nonetheless, other practical difficulties are present.

For example, in U.S. Pat. No. 3,485,218 issued Dec. 23, 1969 to Clarke, there is disclosed a slant axis rotary piston mechanism which may be used as an engine, compressor, expander or the like. In the several embodiments therein illustrated, a number of seals for sealing the various working volumes are carried by housing components but in each case, the various apexes on the rotor flanges must be sealed by seals carried by the rotor. It has been determined that, as a practical matter, interfacing the rotor seals with those carried by the housing to prevent substantial leakgage is extraordinarily difficult. Consequently, while the sealing configuration illustrated in the above identified Clarke patent minimizes parasitic volume, there is sufficient leakage so as to more than overcome the advantage obtained by minimizing parasitic volume.

As a consequence, resort has been made to seal configurations wherein all seals are carried by the rotor so that the various seals may be satisfactorily interfaced with each other to cut leakage to an absolute minimum. This has resulted in seal grid configurations along the lines of that illustrated in U.S. Pat. No. 4,026,662 issued May 31, 1977 to Goloff. A consideration of the operation of a slant axis rotary mechanism and the disposition of the so-called hub seals therein employed when in a grid configuration such as illustrated in the Goloff patent will show that there is a considerable area of the hub between the hub seal and the rotor flange at maximum compression which is closely adjacent the inner spherical wall of the mechanism resulting in considerable parasitic volume at maximum compression and at points in the cycle close to maximum compression. In fact, this parasitic volume becomes non-existent substantially only at full expansion. Thus, while high rates of seal leakage are eliminated by configurations such as shown by Goloff, some undesirable parasitic volume, and the disadvantages accompanying the same, comes into existence.

The present invention is directed to overcoming one or more of the above problems.

DISCLOSURE OF THE INVENTION

According to the present invention there is provided a slant axis rotary piston mechanism including a shaft having an angularly offset eccentric. A housing defines a chamber having a generally spherical portion and which journals the shaft to contain the eccentric. A peripheral, generally sinuous wall is provided for the chamber and extends radially toward the eccentric. A rotor is journalled on the eccentric and has a generally spherical exterior part and a peripheral radial wall. The rotor wall faces the chamber wall and defines with the chamber wall and the housing at least two working volumes whose volume varies as the shaft and rotor rotate relative to the housing. Means are provided for synchronizing relative movement between the shaft, the rotor and the housing and means are provided for directing working fluid into and out of the working volumes.

According to another facet of the invention, seals are disposed on the rotor immediately adjacent the sides of the rotor wall to be carried thereby at its radially inner and outer extremities enabling the entire seal grid to be carried by the rotor while eliminating parasitic volume to thereby improve operational efficiency of the mechanism.

Other objects and advantages will become apparent from the following specification taken in connection with the accompanying drawings.

DESCRIPTION OF THE DRAWINGS

FIG. 2 is a somewhat schematic, developed view of mechanism components in one orientation with respect to each other;

FIG. 3 is a view similar to FIG. 2 and illustrating the relation of the components to each other at a further stage in an operating cycle; and FIG. 4 is a view similar to FIGS. 2 and 3 illustrating the configuration of the components at still a further stage in an operating cycle.

BEST MODE FOR CARRYING OUT THE INVENTION

Figure 1:
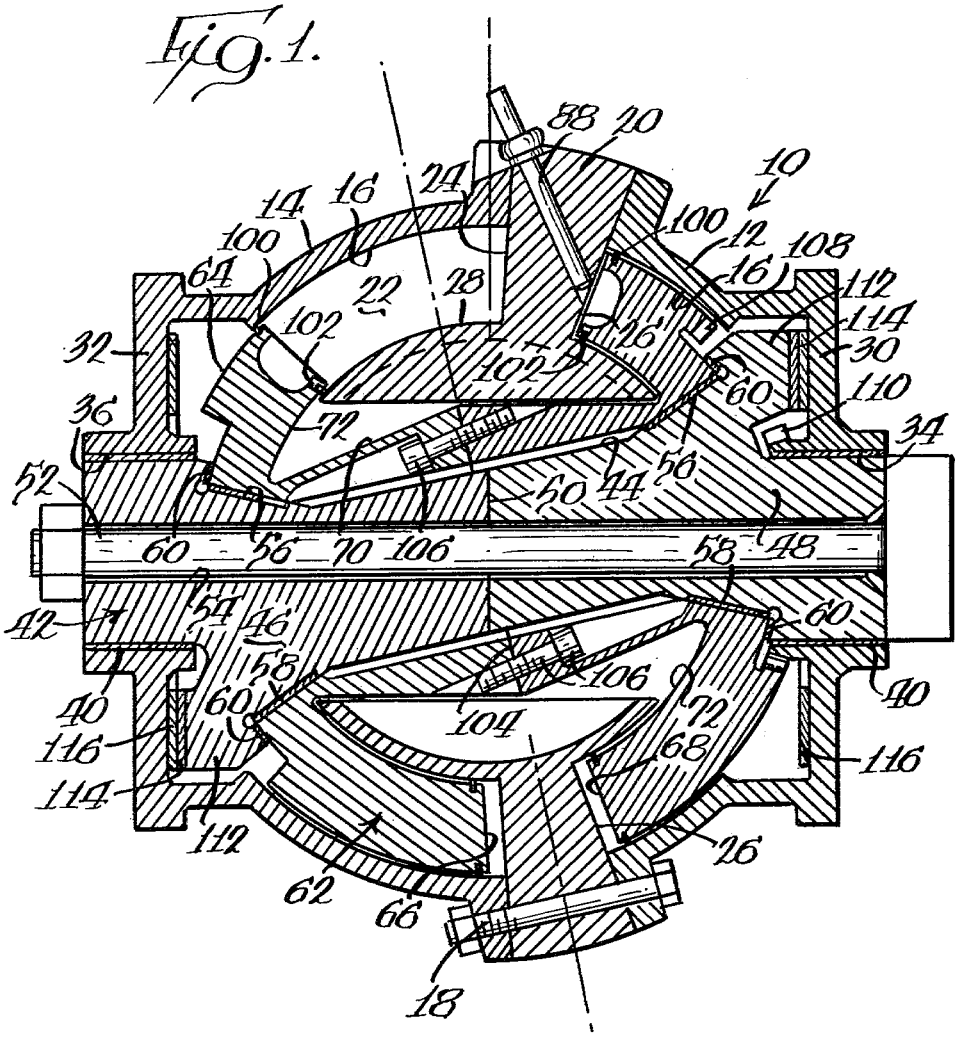
FIG. 1 is a sectional view of a slant axis rotary piston mechanism made according to the invention.

An exemplary embodiment of a slant axis rotary piston mechanism is illustrated in the drawings in the form of a four cycle internal combustion engine preferably operating on diesel cycle. However, it is to be understood that the invention is not limited to a mechanism utilized as an engine as the invention may be advantageously employed in mechanisms operating as compressors, expanders or the like. Similarly, the principles of the invention are not restricted to mechanisms operating on the four stroke principle, nor is the invention to be limited to a diesel cycle engine as the principles of the invention may be advantageously employed in mechanisms having operating cycles other than four stroke and other than the diesel cycle as, for example, the Otto or spark ignition cycle.

Referring to FIG. 1, a mechanism made according to the invention includes a housing, generally designated 10, which, as illustrated, is formed of two parts 12 and 14. Each of the parts 12 and 14 include an inner spherical surface 16 of the same diameter. The housing parts 12 and 14 are assembled together as by a plurality of bolts 18 (only one of which is shown) in such a way as to sandwich a partition 20 between the two housing parts 12 and 14.

As seen in FIG. 1, the partition 20 extends radially inwardly of the spherical wall 16 into a chamber 22 defined by the housing 10. As seen in FIGS. 2–4, opposite sides 24 and 26 of the partition 20 have a sinuous or sinusoidal configuration and the partition 20 extends about the entire periphery of the chamber 22 in the circumferential direction.

Returning to FIG. 1, and recalling the showings of FIGS. 2–4, it can be seen that both of the sides 24 and 26 of the partition are somewhat conical as well as wavey or sinusoidal.

At its radially inner extremity, the partition 2 terminates in a fixed spherical hub 28 located radially inwardly of the spherical wall 16 of the housing 10 by a considerable distance.

Each of the housing parts 12 and 14 has an end wall 30 and 32 respectively. The end walls 30 and 32 have aligned openings 34 and 36 which receive suitable journal bearing 40 which journal a shaft, generally designated 42 for rotation within the housing 10. The shaft 42 includes an angularly offset eccentric 44 disposed within the chamber 22. Preferably, the shaft 44 is made in two parts, 46 and 48, by a split 50 located at the approximate mid-point of the eccentric 44. The shaft parts 46 and 48 are held in assembled relation by a tie bolt 52 extending through a hollow or bore 54 in the shaft parts 46 and 48. The purpose of this construction is to allow a rotor to be assembled to the eccentric 44 as will be seen.

Opposite ends of the eccentric 44 are provided with frusto-conical bearing surfaces 56, the arrangement being such that the minor bases of each frusto-conical bearing 56 are facing each other. Bearings 58 for journalling a rotor are disposed on the surfaces 56.

The bearings 58, at their axially outer extremities, include pilot portions 60 for purposes to be seen.

The mechanism includes a rotor, generally designated 62 which is generally spherical in configuration. The radially outer surface 64 of the rotor is spaced just inwardly of the spherical wall 16 of the housing 10 by a suitable clearance sufficient to prevent interference between the parts. The rotor 62 includes a peripheral groove in the circumferential direction, the groove having facing sidewalls 66 and 68 and a bottom wall 70 which is widened to receive the hub 26 on the radially inner end of the partition 20. The widened bottom 70 of the groove thus defined merges with corresponding sides 66 and 68 via a spherical surface 72 configured to be closely adjacent to the spherical surface 28 on the hub, spaced therefrom by a small distance sufficient to prevent interference between the parts.

Turning to FIGS. 2–4, it will be seen that each of the rotor sides 66 and 68 is provided with a series of three, equally angularly spaced pockets 74 which are separated from each other by apexes 76. The apexes carry apex seals 78 which slidably engage associated sides 24 and 26 of the partition 20 for sealing purposes. Thus, it will be appreciated that each of the pockets 74 defines, together with the corresponding side 24 or 26 of the partition 20, the spherical wall 16 of the housing 10 and the spherical surface 28 of the hub, a working volume. When used as an engine, each of the pockets 74 will further be provided with a so-called "crater" 80 as is known in the art for maximizing combustion efficiency. In the embodiment shown, the apexes 76 on opposite groove sides 66 and 68 are aligned with each other although this need not be the case if the phasing of the sinuous shape of the sides 24 and 26 of the partition 20 is altered from that shown in FIGS. 2–4.

For the phasing illustrated in FIGS. 2–4, and for a mechanism operating on the diesel cycle, at approximately 90° spacing along the partition 20, a first fuel injector 86 opens through the partition side 24 and a second fuel injector 88 opens through the wall 26. Only the injector 88 is illustrated in FIG. 1.

The housing parts 12 and 14 are provided with inlet and outlet ports. In particular, as viewed in FIGS. 2 and 4, an outlet or exhaust port 90 and an inlet or intake port 92 are located on the side 24 of the partition 20 and are spaced from their counterparts 94 and 96 on the side 26 of the partition 20, also by 90°. The ports 90–96 provide a means directing a working fluid to the working volumes of each side of the partition 20.

Referring to FIG. 2, three working volumes A, C and E are shown on the side 24 of the partition 20 while three similar working volumes B, D and F are shown on the side 26 of the partition 20. The working volume C is centered about the ports 90 and 92 and is at one of two points of minimum displacement in the cycle. For the direction of rotor motion illustrated in FIG. 2, the gases of combustion have just been exhausted from the working volume C through the exhaust port 90 at the left side of FIG. 2 and the rotor motion has already established communication between the volume C and the intake port 92 at the right side of FIG. 2. In FIG. 3, the volume of working volume C is increasing with a consequence that the combustion supporting medium, usually air, will be drawn into the working volume C through the inlet port 92. Through this motion, the working volume D on the side 26 of the partition 20 has now moved to minimum displacement in connection with the ports 94 and 96 as shown in FIG. 3.

The working volume A is decreasing in volume and since it is no longer in communication with either of the ports 92 or 90, compression is occurring. As the working volume A progresses through the cycle from the position illustrated in FIG. 2 to the position illustrated in FIG. 4, it is reaching a minimum clearance configuration corresponding to maximum compression and, when approximately at the position shown in FIG. 4, fuel will be injected through the fuel injector 86 and combustion will occur.

Continued rotor motion of the volume A from the position illustrated in FIG. 4 will cause the same to occupy the position shown by volume E in FIG. 2, and this of course represents expansion of the combustion gases. Maximum expansion is shown by the position of the working volume E in FIG. 3 which also shows the maximum volume of any working volume in the cycle. Continued rotor motion causes the volume of the working volume E to begin to decrease and at this time, fluid communication with the exhaust port 90 is established as shown in FIG. 4. Because the volume is decreasing, the gases of combustion will be driven from the working volume E out of the exhaust port 90.

With the foregoing operational cycle in mind, reference is made to FIG. 1 wherein it is seen that radially outer peripheral seals 100 and radially inner peripheral seals 102 are carried by the rotor 62 and sealingly engage the spherical wall 16 of the housing 10 and the spherical hub 28, respectively for any position of rotor rotation within the chamber 22. The seals 100 and 102 are carried by the rotor in immediate adjacency to the walls 66 and 68 forming the rotor groove around the entire periphery of the groove. The location of the seals 100 and 102 is also shown in dotted lines in FIG. 4 and it will be appreciated from the showing thereof that parasitic volume of any consequence cannot come into existence. It will also be seen from FIG. 4 that the seals 100 and 102 may be interfaced easily with the apex seals 78 as by means of conventional bolt seals or the like. Thus, the entire seal grid is carried by the rotor and yet parasitic volume is eliminated.

Returning to FIG. 1, the rotor 62 is preferably split at its midpoint in the groove defined by the walls 66, 68 and 70 and as shown at 104. Cap screws 106 may be utilized as illustrated to assemble the rotor parts together and in this connection, the bearing parts 60 act to pilot the rotor parts into the proper position on the eccentric 44 as well as act in connection with the bearings 58 as journal and thrust bearings.

The requisite phasing between the components is achieved by a ring gear 108 carried on one side of the rotor 62 which meshes with a gear 110 within the housing and carried by the housing part 12 in concentric relation to the opening 34. As is well known, for a four stroke cycle, the gearing will be such that the shaft 44 will rotate through three revolutions for each single rotation of the rotor 62.

The gas loads on the rotor 62 impart thrust forces to the shaft 42 as is well known in slant axis rotary piston mechanisms and to this end, opposite ends of the eccentric 44 within the housing include noncircumferential bearing mounts 112 which mount thrust bearing pads 114. The thrust bearing pads 114 carried by the bearing mounts 112 are engaged with peripheral thrust bearing pads 116 carried by the ends 30 and 32 of the housing parts 12 and 14 respectively. Thus, axial length of the mechanism made according to the invention may be less than prior art slant axis rotary piston mechanisms which frequently carry thrust bearings interposed between the shaft and the housing at locations considerably exterior from the housing chamber 22.

INDUSTRIAL APPLICABILITY

From the foregoing it will be appreciated that a slant axis rotary piston mechanism made according to the invention may be fabricated utilizing the basic design characteristics, including the formula, set forth in the previously identified Clarke patent, the details of which are herein incorporated by reference; and operate generally similarly thereto to provide the advantages thereof. At the same time, however, a mechanism made according to the present invention completely eliminates the leakage problems encountered in a mechanism of the type therein described by disposing the entire seal grid on the rotor. Moreover, the present invention eliminates the difficulties associated with parasitic volume encountered in previous constructions wherein the entire seal grid was carried by the rotor.

I claim:

1. A slant axis rotary piston mechanism comprising:

a shaft (42) having an angularly offset eccentric (44);

a housing (10) defining a chamber (22) having a generally concave spherical portion (16) and journalling said shaft and containing said eccentric;

a peripheral, generally sinuous wall (20, 24, 26) for said chamber extending radially toward said eccentric and terminating in an inner convex spherical wall (28) extending about said eccentric;

a rotor (62) journalled on said eccentric having generally spherical exterior and interior parts (64, 72) and a peripheral, radial wall (66, 68), said rotor wall facing said chamber wall and defining with said chamber wall and said housing at least two working volumes (A, B, C, D, E, F) whose volume varies as the shaft and rotor rotate relative to the housing;

seals (100, 102) carried by said rotor spherical parts immediately adjacent said radial wall and sealing engaging respective ones of said spherical portion and said spherical wall;

means (108, 110) for synchronizing relative movement between the shaft, the rotor and the housing; and means (90–96) for directing working fluid into and out of said working volumes.

2. A slant axis rotary piston mechanism comprising:

a shaft (42) having an angularly offset eccentric (44);

a housing (10) defining a generally spherical chamber (22) and journalling said shaft and containing said eccentric;

a peripheral, generally sinuous partition (20) fixed in said housing extending radially into said chamber toward said eccentric to terminate in an inner spherical wall with shaft extending therethrough;

a rotor (62) journalled on said eccentric and of generally spherical exterior configuration (64) and having a peripheral groove (66,68,70) extending about and opening to the periphery of the rotor, each of the sides (66,68) of said groove facing a corresponding side (24, 26) of said partition and having at least two equally angularly spaced apexes (76) separated by pockets (74) to define with said corresponding side and said housing at least two working volumes (A-F) whose volume varies as the shaft and rotor rotate relative to the housing, said groove being widened at its bottom (70) to receive said inner spherical wall;

means (108, 110) for synchronizing relative movement between the shaft, the rotor and the housing;

means (90–96) for directing working fluid into and out of said working volumes; and peripheral seals (100,102) on said rotor immediately adjacent said groove sides at their radially inner and outer extremities and sealingly engaging said spherical chamber and said inner spherical wall.

3. The slant axis rotary piston mechanism of claim 2 wherein said partition sides (24,26) each have a sinusoidal and conical configuration.

4. The slant axis rotary piston mechanism of claim 2 wherein said eccentric has opposite ends (112) within said housing; and thrust bearing means (114, 116) formed on each of said opposite ends and slidably engaging said housing about the axis of said shaft.

5. The slant axis rotary piston mechanism of claim 2 wherein said shaft is hollow (54) and is split (50) into two parts (46,48) in the area of said eccentric so that said rotor may be fitted thereon and a tie bolt (52) extending through said parts to hold said shaft parts in assembled relation.

6. The slant axis rotary piston mechanism of claim 2 wherein said eccentric includes frusto conical bearing means (56) for journalling said rotor at each of its ends with the minor bases of said bearing means facing each other, and wherein said shaft is split (50) into two parts (46,48) between said bearing means; and means (52) holding said parts in assembled relation.

7. The slant axis rotary piston mechanism of claim 2 wherein said housing is formed of at least two housing parts (12, 14) sandwiching said partition between the two.

8. The slant axis rotary piston mechanism of claim 2 wherein said rotor is split (104) into two parts in said groove; and means (106) holding said parts in assembled relation.

* * * * *